US008414717B2

(12) United States Patent
Buha

(10) Patent No.: US 8,414,717 B2
(45) Date of Patent: Apr. 9, 2013

(54) METHOD OF HEAT TREATING MAGNESIUM ALLOYS

(76) Inventor: Joka Buha, Kingsford (AU)

( * ) Notice: Subject to any disclaimer, the term of this patent is extended or adjusted under 35 U.S.C. 154(b) by 0 days.

(21) Appl. No.: 12/597,914

(22) PCT Filed: Apr. 29, 2008

(86) PCT No.: PCT/AU2008/000585

§ 371 (c)(1),
(2), (4) Date: Oct. 28, 2009

(87) PCT Pub. No.: WO2008/138034

PCT Pub. Date: Nov. 20, 2008

(65) Prior Publication Data

US 2010/0132852 A1 Jun. 3, 2010

(51) Int. Cl.
*C22C 23/00* (2006.01)
*C21D 1/00* (2006.01)

(52) U.S. Cl.
USPC ..... 148/666; 148/559

(58) Field of Classification Search ..... 148/559, 148/666
See application file for complete search history.

(56) References Cited

U.S. PATENT DOCUMENTS 2,622,049 A 12/1952 Hesse
3,119,689 A 1/1964 Saia

FOREIGN PATENT DOCUMENTS

EP 1016477 A2 7/2000
WO 2004013364 A1 2/2004

*Primary Examiner* — Keith Walker
*Assistant Examiner* — Alexander Polyansky

(57) ABSTRACT

A method for the low temperature heat treatment of an age-hardenable magnesium based alloy, including following steps:

(a) providing a solution heat-treated and quenched age-hardenable magnesium based alloy; and (b) subjecting said alloy to low temperature ageing below 100°C. for a period of time sufficient to develop an enhanced ageing response.

19 Claims, 10 Drawing Sheets

(a)

(b)

METHOD OF HEAT TREATING MAGNESIUM ALLOYS

FIELD OF THE INVENTION

This invention relates to the heat treatment of magnesium alloys that can be strengthened by precipitation hardening, known also as ageing or age hardening. This invention particularly relates to a low temperature ageing process for strengthening precipitation-hardenable magnesium alloys.

BACKGROUND TO THE INVENTION

Alloys in which the solubility of at least one of the alloying elements decrease with decreasing temperature can be strengthened by age hardening. Age hardening is common to a number of alloying systems including magnesium alloys. The age hardening process in general involves three stages:

1) Solution heat treatment—in this stage an alloy is held at a very high temperature (close to the alloy solidus temperature) in order to obtain a single phase solid solution and to dissolve the alloying elements in the magnesium matrix.

2) Quenching—rapid cooling from the temperature of solution heat treatment using a quenching medium (such as cold water) in order to retain alloying elements in the solid solution and obtain a supersaturated solid solution.

3) Holding the as-quenched alloy at an intermediate temperature (artificial ageing) in order to promote the decomposition of the highly unstable supersaturated solid solution in which the alloying elements, often including the magnesium atoms, form precipitates throughout grains.

The strengthening during ageing generally occurs as a result of the formation of a fine dispersion of precipitates that reinforce the magnesium matrix and represent obstacles to movement of dislocations, thus increasing the alloy's ability to resist the deformation leading to failure. Generally, optimal strengthening is achieved in the presence of a high density of uniformly distributed and very closely spaced precipitates that cannot be easily bypassed by gliding dislocations.

Many cast and wrought magnesium alloys are age-hardenable. The most common are those based on the systems Mg—Zn(—Zr) (ZK series), Mg—Zn—Cu (ZC series), Mg—Zn-RE (ZE and EZ series; where RE means rare earth elements), Mg—Zn—Mn(—Al) (ZM series), Mg—Al—Zn (—Mn) (AZ and AM series), Mg—Y-RE(—Zr) (WE series), Mg—Ag-RE(—Zr) (QE and EQ series), Mg—Sn(—Zn, Al, Si) based alloys etc. In each system, magnesium typically comprises more than 85 weight %. Magnesium alloys containing Zn as the major alloying element are precipitation hardenable and comprise a great proportion of currently used magnesium alloys.

While the following description will focus on Mg—Zn alloys, it is to be understood that the invention is not limited to those alloy compostions and is applicable to all precipitation hardenable magnesium based alloys.

Heat treatable magnesium alloys are generally subjected to an elevated temperature heat treatment (commonly referred to in the art as "T6") wherein the stage of artificial ageing (stage (3) of the age hardening process above) is conducted typically at a temperature between 150° C. and 350° C.

In the case of Mg—Zn alloys, the precipitation sequence above ~110° C. has been reported to be:

$$SSSS \rightarrow (\text{pre-}\beta') \rightarrow \beta'_1 \text{ rods} \perp \{0001\}\text{Mg (possibly } MgZn_2) \rightarrow \beta'_2 \text{ discs} \parallel \{0001\}\text{Mg } (MgZn_2) \rightarrow \beta \text{ equilibrium phase } (MgZn \text{ or } Mg_2Zn_3)$$

The structure, composition and the stability of some of these phases have not yet been fully investigated and determined, however a number of reports agree that the maximal hardening due to the precipitation in Mg—Zn based alloys subjected to a conventional T6 heat treatment is associated with the formation of the rod-shaped transition $\beta'_1$ phase. This phase forms perpendicular to the basal plane of Mg, possibly via another transition phase denoted pre-β'. On overageing, $\beta'_1$ is replaced by a coarse $\beta'_2$ phase in the form of a plate parallel to the Mg basal plane. The equilibrium β phase, MgZn or $Mg_2Zn_3$, may form upon high overageing. Precipitation at reduced temperatures (~<110° C.) has not been clearly observed by transmission electron microscopy (TEM). While it is believed that GP zones may possibly form at reduced temperatures, the formation, structure, thermal stability and the sequence of the formation of GP zones have not yet been clarified.

Although many magnesium alloys undergo precipitation hardening, currently the most effective methods of increasing their mechanical properties preferably still include solid solution hardening, dispersion hardening and grain refinement. Even then, the tensile properties of most heat treatable magnesium alloys are limited compared to those of the currently used aluminum alloys, which is one of the main limitations for the wider application of magnesium alloys. Age hardening of magnesium alloys is generally not considered as being as effective in improving tensile properties as it is in the case of aluminum alloys. This is believed to be primarily because the number density of the precipitates formed during the conventional T6 ageing in magnesium alloys is several orders of magnitude lower than in the aged aluminum alloys. Therefore widely spaced precipitates that form in the T6 condition of magnesium alloys are easily bypassed by gliding dislocations and such alloys display reduced resistance to deformation.

Strengthening of magnesium alloys through age hardening would become more effective in the case of the formation of higher density of finely dispersed precipitates throughout the microstructure.

It would accordingly be desirable to make precipitation hardening more effective in increasing strength. This can then be used alone or in the combination with work hardening and grain refinement to increase the upper limit of the mechanical properties that can be achieved in magnesium alloys, thereby enabling wider and more competitive use of these light weight alloys. It would be particularly desirable to make precipitation strengthened magnesium alloys more ductile. It would also be desirable to improve those properties using an ageing process able to be conducted at lower temperatures than those of the conventional T6 ageing.

The present invention is based upon the surprising discovery by the inventor that age hardening of magnesium based alloys can be effected at significantly lower temperatures than are typically used during conventional T6 ageing, such as at ambient temperature. Moreover, the ageing response achievable using the invention can be comparable to or in some cases exceed, that achieved using conventional T6 ageing.

Age hardening at ambient temperature of any notable magnitude has never previously been observed in age-hardenable magnesium alloys, including the Mg—Zn based alloys, and it has been assumed that magnesium alloys therefore do not show any significant precipitation hardening response when held at reduced temperatures such as close to ambient temperature after quenching from the solution heat treatment temperature.

SUMMARY OF THE INVENTION

According to the present invention, there is provided a method for the low temperature heat treatment of an age-hardenable magnesium-based alloy, including the steps:

(a) providing a solution heat-treated and quenched age-hardenable magnesium based alloy having a close packed hexagonal lattice structure; and (b) subjecting said alloy to low temperature ageing below 100° C. for a period of time sufficient to develop an enhanced ageing response comprising an improvement in tensile strength and one or more of peak hardness, yield strength, ductility and fracture toughness, wherein the aged alloy includes Guinier-Preston (GP) zone type precipitates including GP1 and GP2 (as herein defined) precipitates formed perpendicular to the magnesium basal plane.

The present invention also provides a method for producing an age-hardenable magnesium-based alloy, including the steps:

(a) solution treating, within a suitable elevated temperature range or ranges, an age-hardenable magnesium based alloy for a time or times sufficient to allow the elements active in the precipitation reaction to be dissolved into solid solution;

(b) quenching the solution treated alloy from the temperature cycle for step (a) whereby the dissolved elements are retained in a supersaturated solid solution to produce a quenched alloy having a close-packed hexagonal lattice structure; and (c) subjecting the quenched alloy from step (b) to low temperature ageing below 100° C. for a period of time sufficient to develop an enhanced ageing response comprising an improvement in tensile strength and one or more of peak hardness, yield strength, ductility and fracture toughness, wherein the aged alloy includes Guinier-Preston (GP) zone type precipitates including GP1 and GP2 (as herein defined) precipitates formed perpendicular to the magnesium basal plane.

The enhanced ageing response typically comprises at least an improvement in both tensile strength and ductility. A practical effect of this is that, unlike prior art heat treatment processes in which alloys should be formed before ageing, alloys which have been aged according to the present invention can be formed after the inventive process.

The enhanced ageing response is preferably comparable to or exceeding that of an alloy of the same composition subjected to a T6 ageing stage.

DETAILED DESCRIPTION OF THE INVENTION

The inventive heat treatment is applicable to any precipitation-hardenable magnesium-based alloy and to both casting and wrought magnesium based alloys. It is particularly applicable to magnesium alloys containing zinc as one of the major alloying elements, such as the ZK, ZM and ZC series, and alloys containing rare earth elements or tin.

The inventive heat treatment is very effective for both casting and wrought Mg—Zn based alloys that contain ageing accelerants, ie alloying elements that aid nucleation of precipitates and increase the nucleation rate. These alloying elements assist to increase the number density of precipitates and accelerate the rate of ageing at low temperatures, especially at ambient temperatures.

An example of an alloying element that accelerates age hardening at reduced temperatures, in particular at ambient temperatures, in magnesium alloys containing Zn as the major alloying element is Cu (the ZC series of magnesium alloys). Addition of Cu in the amount as low as 0.1 atomic % will significantly accelerate age hardening even at ambient temperature. Addition of further alloying elements in addition to Cu, that affect the precipitation processes and generally promote nucleation of precipitates will also accelerate age hardening at reduced temperature. Examples of other accelerants instead of copper or in addition to copper are manganese, aluminium and particularly titanium, also vanadium, chromium and barium as a moderate accelerant.

As a result of the alloying additions, the low temperature heat treatment can be accelerated, resulting in improved mechanical properties, such as ductility, strength and hardness levels, comparable to or better than those in the T6 condition. Fracture toughness of alloys can be also significantly improved, using the process of the invention.

Without wishing to be restricted to a particular mechanism, it is believed that the modified mechanical properties of the alloys aged at reduced temperature according to the invention are produced due to the precipitation of a very high density of closely spaced Guinier-Preston (GP) zone type precipitates of 3 to 30 nm in size, instead of the coarser and considerably more widely spaced precipitates typically formed during the T6 heat treatment. Accordingly, the inventor has found that low temperature ageing should occur at temperatures significantly less than those conventionally used during T6 (150° C.-350° C.). The density of the precipitates in the low temperature aged condition is significantly higher than what is commonly observed in the T6 condition of magnesium alloys (~$10^{18}$-$10^{20}$ precipitates/$m^3$) and is often of the order of precipitate density in a typical heat treated aluminum alloy, ie $10^{23}$-$10^{24}$ precipitates/$m^3$. The fraction of each of the three types of GP zones can be controlled by the alloy composition, in particular the amount of the alloying additions other than Zn, and also by the ageing temperature. At temperatures close to ambient temperatures, strengthening is produced mainly by the formation of GP1 zones (planar precipitates perpendicular to the basal plane of magnesium), and prismatic precipitates perpendicular to the basal plane of magnesium, hereinafter designated as GP2 zones. Increase in the heat treatment temperature above ~70° C. leads to the formation of the additional and thermally more stable GP zone type phase, hereinafter designated as GP3 zones (discs/plates parallel to basal plane of magnesium). When the alloying additions other than Zn are added in a larger amount (more than about 1 weight %), formation of GP1 zones is more favorable than the formation of GP2 zones during ambient temperature ageing, while GP2 zones are the more dominant type of precipitate in the absence of any alloying elements other than Zn and when these additions are very small.

The low temperature heat treatment is conducted after a typical solution heat treatment at a typical solution heat treatment temperature for a chosen alloy, optimally 5°-20° C. below the alloy solidus temperature for at least 1 hour. Preferably, the solution heat treatment temperature should be chosen closer to the upper limit in order to ensure maximum solubility of the alloying elements as well as vacancies in solid solution, so that a high supersaturation of alloying elements and vacancies is achieved in the as-quenched condition. Age hardening response during heat treatment described in the present application, especially the ambient temperature hardening, can be sensitive to the solution heat treatment temperature and the rate of quenching from this temperature.

After solution heat treatment, alloys should be rapidly quenched, ie, not simply cooled, in an appropriate quenching medium (such as cold water or other medium). After quenching, the alloy is typically immediately transferred to the ageing temperature, or left at ambient temperature in the case of an ambient temperature heat treatment.

The low temperature ageing is typically conducted between ambient temperature and 110° C.±10° C. Where the selected temperature is ambient temperature, the ageing process advantageously does not require energy consumption for heating. In one embodiment, the ageing is conducted at higher than ambient temperature in order to reduce the ageing time. In another embodiment, low temperature ageing is conducted at less than 100° C. In another embodiment, low temperature ageing is conducted at less than or equal to 95° C.

Typically, the low temperature ageing is conducted for at least 24 hours. The length of the ageing treatment is dependent on the temperature of ageing. At ambient temperature, ageing is usually conducted for a minimum of 2 to 16 weeks. The length of ageing depends on the temperature of ageing and whether any accelerants are present in the alloy. In some embodiments, ageing is conducted for at least 4 weeks. In other embodiments, ageing is conducted for a minimum of 8 weeks. In yet further embodiments, ageing is conducted for a minimum of 12 weeks. For low temperature ageing conducted at higher than ambient temperature, or where the alloy composition includes one or more accelerants, the length of ageing typically decreases. In yet further embodiment, ageing at reduced temperature is conducted for a time sufficient to obtain a favorable combination of tensile properties such as appreciably high yield strength (and hardness) and enhanced ductility when compared to T6 condition. Once the optimal mechanical properties are attained, they remain stable at ambient temperature and there is little likelihood of over-ageing.

The use of temperatures higher than ambient temperatures typically requires heating in a furnace or in an oil bath. For alloys aged at higher than ambient temperature, the optimal mechanical properties are reached after a significantly shorter heat treatment time. For ageing at temperatures below ~75° C., mechanical properties comparable to those in the T6 condition can be achieved after a minimum of about 110 hours of ageing and exceeded after prolonged ageing. For ageing at temperatures above 95° C., optimal mechanical properties are typically achieved after ageing for at least 100 hours.

Alloys subjected to ambient temperature ageing for 4 to 16 weeks or longer if needed, in comparison to the T6 condition exhibit high hardness, improved ductility and fracture toughness, combined with a reasonable tensile strength. An increase in the heat treatment temperature and the change of the GP zone type, size, morphology and density in general results in the increase in the tensile strength and hardness while the ductility and fracture toughness remain improved compared to the T6 condition.

DESCRIPTION OF THE DRAWINGS

In order that the invention may be more readily understood, description now is directed to the accompanying drawings, in which:

FIG. 1 compares the respective temperature-time regimes for solution heat treatment, conventional T6 ageing, and the low temperature ageing process of the present invention. The low temperature ageing of the present invention occurs at a lower temperature, but often for a longer time, than that of T6.

In FIGS. 2 to 8, the ageing response for a number of different solution heat treated and quenched Mg alloys are compared. The alloy compositions and the conditions of solution heat treatment followed by quenching in cold water are as follows:

Mg-7Zn: solution heat treated at 340° C. for 5 hours.

Mg-6Zn-3Cu-0.1Mn: solution heat treated at 440° C. for 5 hours.

Mg-6Zn-0.8Cu-0.1Mn: solution heat treated at 390° C. for 5 hours.

Mg-4.6Zn-0.4Cu: solution heat treated at 435° C. for 5 hours.

Mg-6Zn-1.8Cu-0.1Mn: solution heat treated at 460° C. for 5 hours.

Mg-6Zn-0.8Ti: solution heat treated at 340° C. for 4 hours.

Mg-6Zn-0.2Cr: solution heat treated at 360° C. for 5 hours.

Mg-7Zn-0.3V: solution heat treated at 360° C. for 5 hours.

Mg-7Zn-1.2Ba: solution heat treated at 430° C. for 5 hours.

Figure 1:
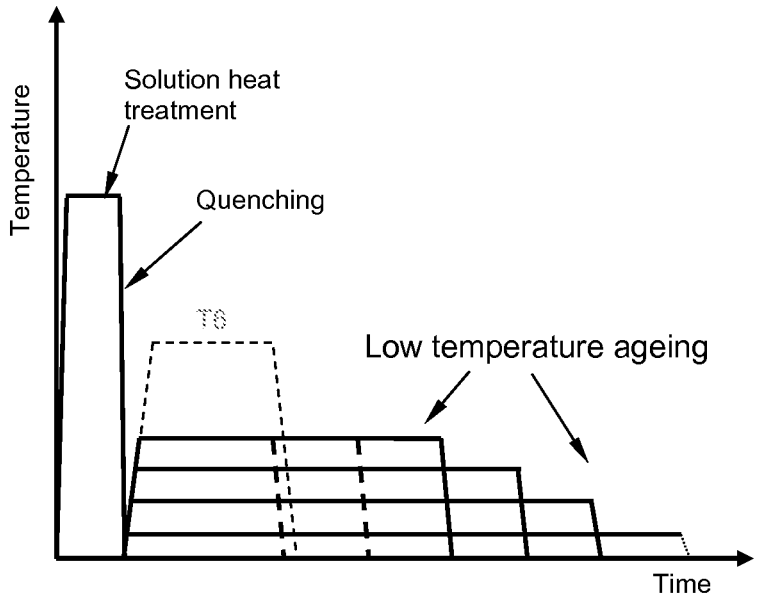
FIG. 1. Temperature vs time graphs comparing the respective heat treatments wherein the alloys are aged at reduced temperatures after a typical solution heat treatment as opposed to the T6 heat treatment that is typically conducted at considerably higher temperatures.
Figure 2:
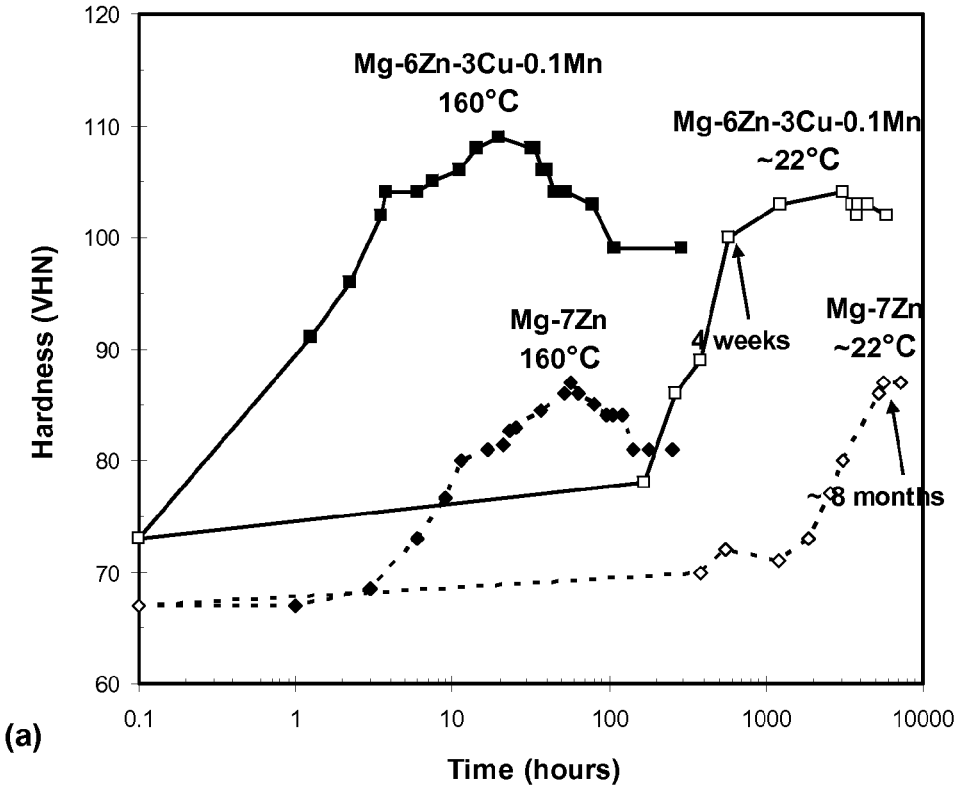
FIG. 2. Hardness (VHN) vs Time (hours, log scale) plots showing: (a) a comparison of the hardness curves for ageing at 160° C. (T6) and ~22° C. of alloys Mg-6Zn-3Cu-0.1Mn and Mg-7Zn; (b) a comparison of the hardness curves for ageing at 160° C. (T6), 95° C., 70° C. and ~22° C. for alloy Mg-6Zn-3Cu-0.1Mn.
Figure 2:
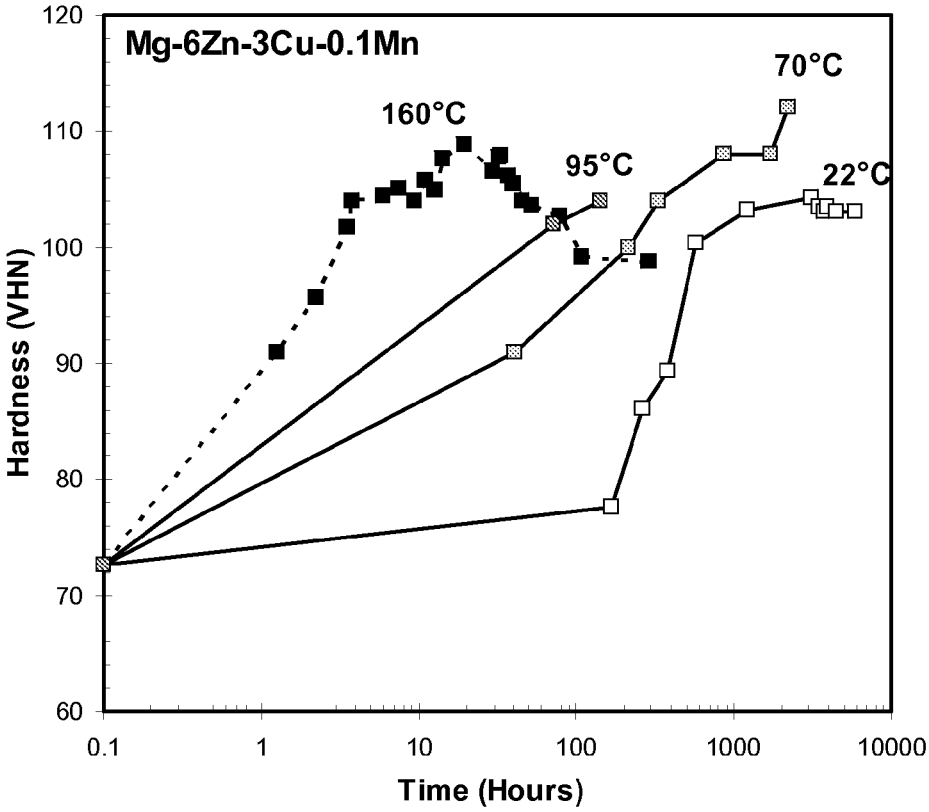

FIG. 2(*a*) compares the hardness curves for two casting magnesium based alloys: Mg-7Zn and Mg-6Zn-3Cu-0.1Mn which have been each aged at 160° C. (ie under the T6 condition) and at ambient temperature, (~22° C.) respectively. For both alloys hardness achieved during ambient temperature ageing (104 VHN and 89 VHN for Mg-6Zn-3Cu-0.1Mn and Mg-7Zn alloys respectively) almost equals that achieved by ageing in the T6 condition (109 VHN and 87 VHN for Mg-6Zn-3Cu-0.1Mn and Mg-7Zn alloys respectively). In the case of the Mg-7Zn alloy ageing time required for this is nearly 8 months (86 VHN after 5208 hours). However in the ZC type alloy hardness in the ambient temperature aged condition almost equals that in the T6 condition after ageing for more than 4 weeks. The ageing response (in terms of hardness) to ambient temperature ageing is significantly improved and accelerated in the presence of Cu and the addition of Mn in alloy Mg-6Zn-3Cu-0.1Mn. FIG. 2(*b*) compares the hardness curves for ageing alloy composition Mg-6Zn-3Cu-0.1 Mn at 160° C. (T6), 95° C., 70° C. and ~22° C., respectively. It can be seen that reduced temperature ageing, in particular at the temperatures above the ambient temperature significantly improves the age hardening response of alloy compared to the T6 heat treatment.

Figure 3:
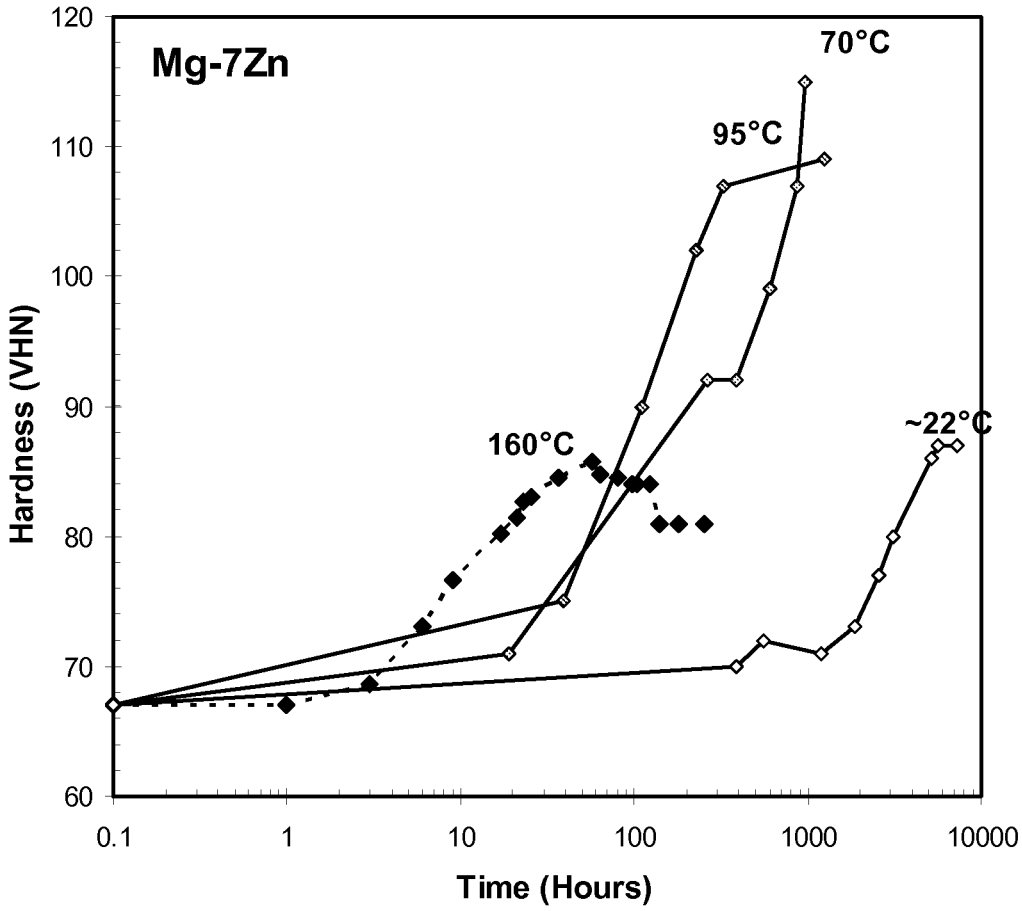
FIG. 3. Hardness (VHN) vs Time (hours) plots showing a comparison of the hardness curves for ageing at 160° C. (T6), 95° C., 70° C. and ~22° C. for alloy Mg-7Zn.

FIG. 3 compares the hardness curves for ageing alloy composition Mg-7Zn at 160° C. (T6) 95° C., 70° C. and ~22° C. Although ageing at ambient temperature requires a long time for hardness to equal that in the T6 condition (nearly 8 months), ageing at 95° C. and 70° C. significantly improves age hardening response and a remarkable improvement in the alloy hardness can be achieved after ageing for a relatively short length of time (typically after 250 hours of ageing).

Figure 4:
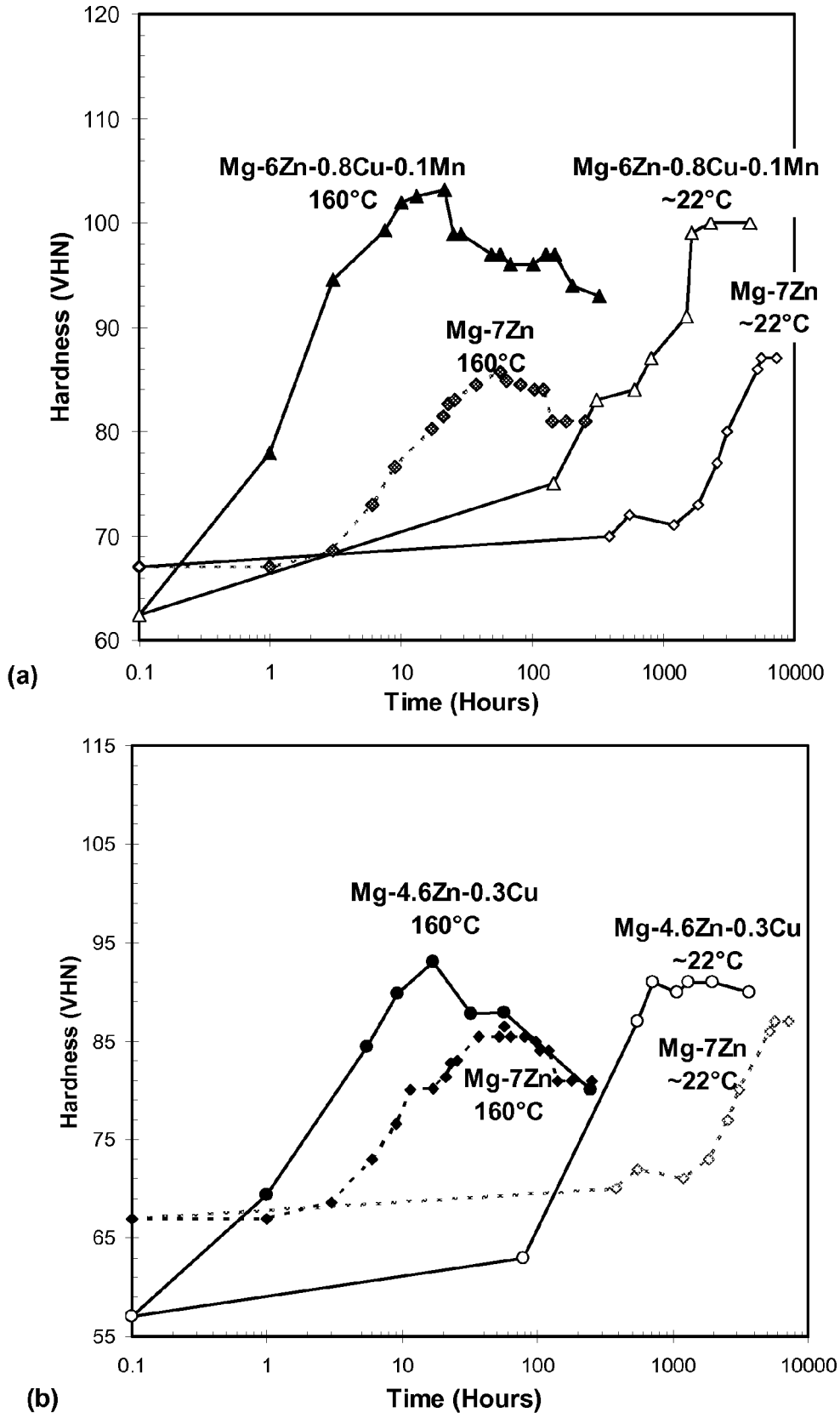
FIG. 4. Hardness (VHN) vs Time (hours) plots showing a comparison of the hardness curves for ageing at 160° C. (T6) and ~22° C. for alloys: (a) Mg-6Zn-0.8Cu-0.1Mn and Mg-7Zn; (b) Mg-4.6Zn-0.4Cu and Mg-7Zn.

FIG. 4(*a*) compares the hardness curves for ageing alloy compositions Mg-6Zn-0.8Cu-0.1Mn, and Mg-7Zn, at ageing temperatures of 160° C. (T6) and ~22° C. This figure shows that the accelerated age hardening at ambient temperature and hardness level comparable to that in the T6 condition can be achieved even when the content of the alloying element stimulating the accelerated age hardening is reduced. Likewise, for ageing alloy composition Mg-4.6Zn-0.4Cu after only 4 weeks of ambient temperature ageing, hardness equals that of an alloy aged in the T6 condition. This is shown in FIG. 4(*b*) and compared with alloy Mg-7Zn for at ageing temperatures of 160° C. (T6) and ~22° C. This result indicate that an addition of even a trace amount of alloying elements that stimulate nucleation of precipitates, such as Cu, will significantly accelerate and improve the age hardening response to reduced temperature ageing even in the absence of other alloying elements commonly added to improve tensile properties, corrosion resistance, grain refinement etc. (Mn, Al, Zr, etc.). FIGS. 4(*a*) and (b) also indicate that the reduced temperature heat treatment is applicable to alloys with lower levels of alloying elements i.e., wrought Mg—Zn based alloys.

Figure 5:
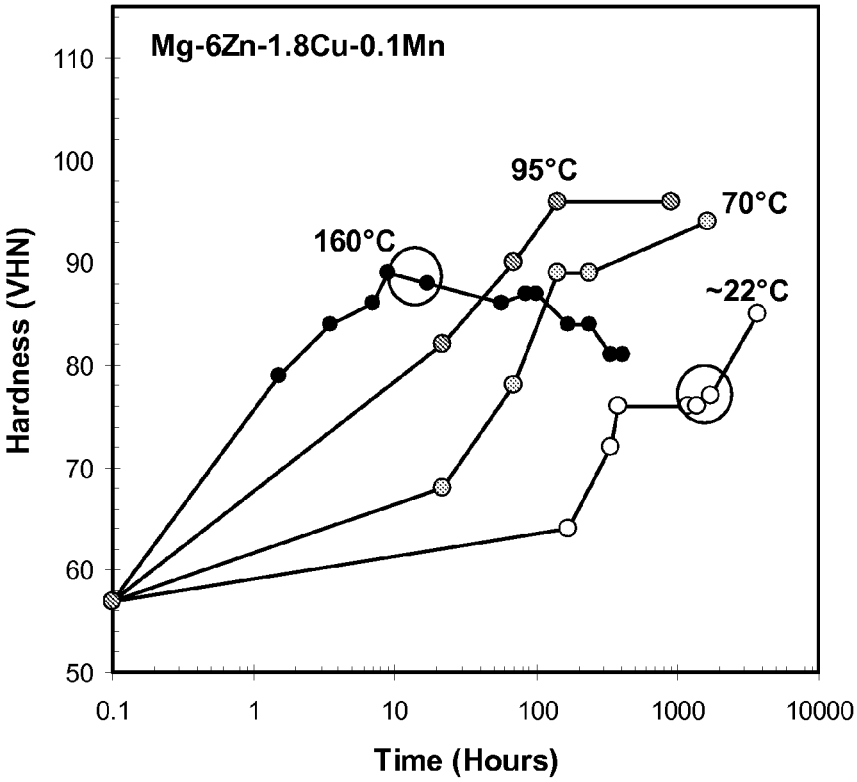
FIG. 5. Hardness (VHN) vs Time (hours) plots showing a comparison of the hardness curves for ageing at 160° C. (T6), 95° C., 70° C. and ~22° C. for a large scale casting of alloy Mg-6Zn-1.8Cu-0.1Mn.

FIG. 5 compares the hardness curves for ageing a large scale casting of an alloy composition Mg-6Zn-1.8Cu-0.1Mn. As can be seen, the peak hardness achieved for alloys aged at 95° C. and 70° C. exceed that of the T6 condition, while hardness achieved for ageing at 22° C. nearly equals that in the T6 condition after about 5.5 months of ageing. The reduced response to ambient temperature ageing compared to a smaller size casting of alloy of a similar composition is due to a reduced rate of quenching of larger metal pieces.

Table 1 shows hardness and tensile properties of the alloy Mg-6Zn-1.8Cu-0.1Mn aged at 160° C. for 16 hours (circled on the hardness curve in FIG. 5) and at ~22° C. for 2180 hours (~13 weeks, also circled on the hardness curve). A significant improvement in the ductility (three times the T6 value) was achieved in the naturally aged condition combined with 72% of the T6 0.2% proof stress, 86.5% of the T6 peak hardness, and significantly improved tensile strength (UTS).

TABLE 1

| Heat treatment | Peak hardness (VHN) | 0.2% Proof Stress (MPa) | UTS (MPa) | Elongation (%) |
|---|---|---|---|---|
| Peak aged at 160° C. (T6) | 89 | 168 | 220 | 2.8 |
| Aged at ~22° C. | 77 | 121 | 253 | 8.6 |

TABLE 1-continued

| Heat treatment | Peak hardness (VHN) | 0.2% Proof Stress (MPa) | UTS (MPa) | Elongation (%) |
|---|---|---|---|---|

Figure 6:
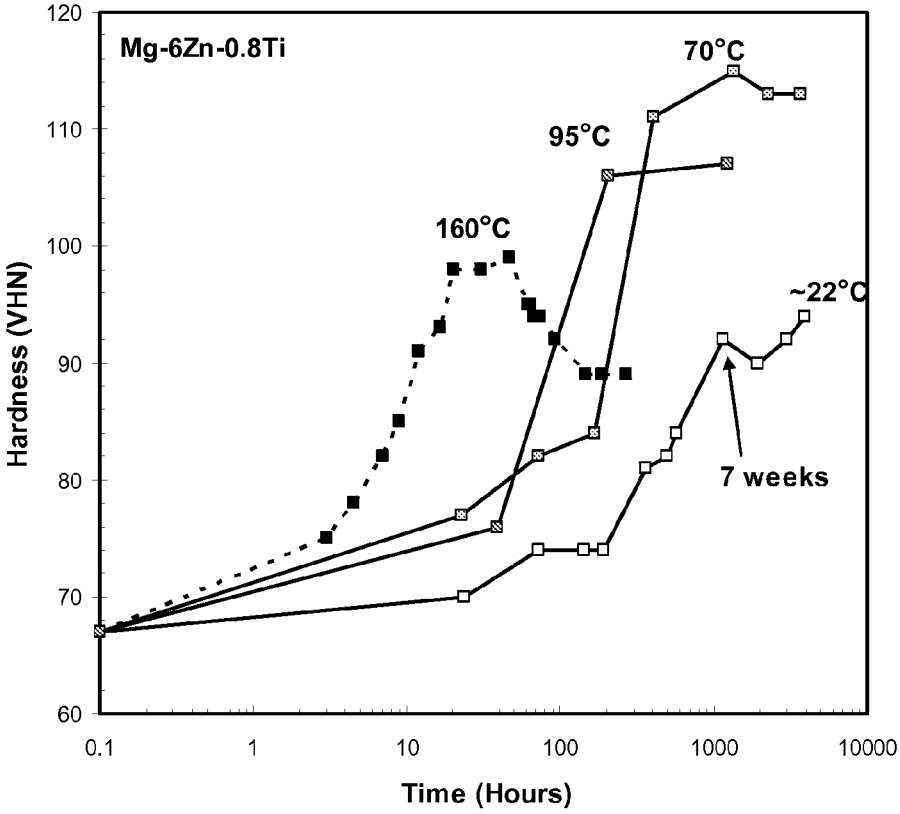
FIG. 6. Hardness (VHN) vs Time (hours) plots showing a comparison of the hardness curves for ageing at 160° C. (T6), 95° C., 70° C. and ~22° C. for alloy Mg-6Zn-0.8Ti.

FIG. 6 shows that titanium represents another very effective accelerant of reduced temperature ageing and hardness in the naturally aged condition nearly equaled that in the T6 after 7 weeks. The peak hardness achieved for ageing at 95° C. and 70° C. exceed that of the T6 condition of the same alloy. This element also improves the magnitude and kinetics of artificial ageing when compared to alloy Mg-7Zn.

Figure 7:
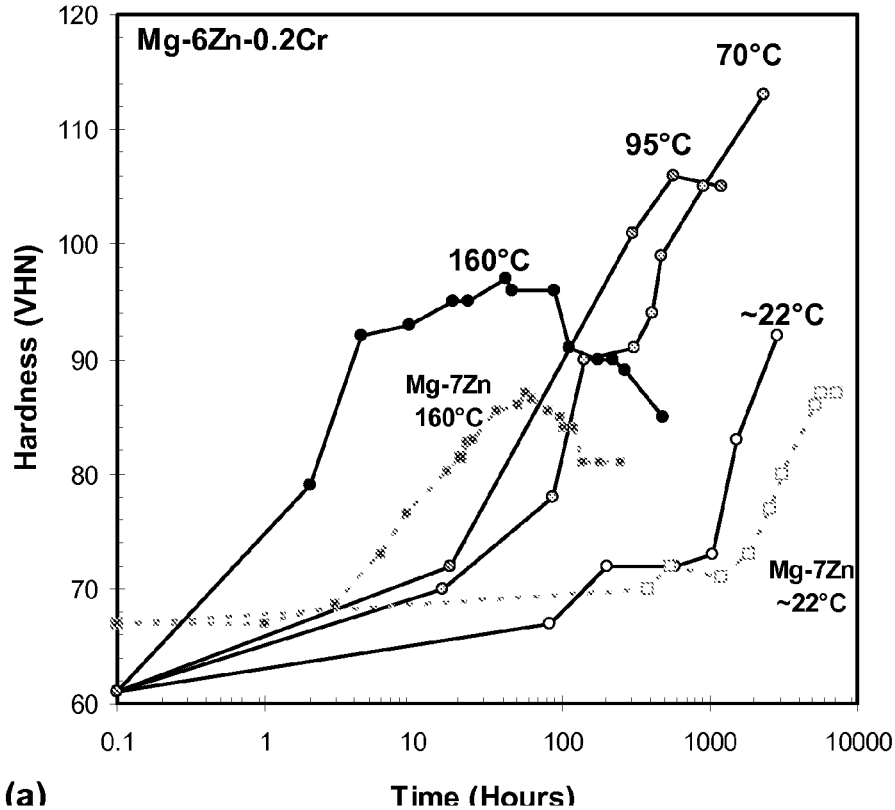
FIG. 7. Hardness (VHN) vs Time (hours) plots showing a comparison of the hardness curves for ageing at 160° C. (T6), 95° C., 70° C. and ~22° C. for alloys: (a) Mg-6Zn-0.2Cr and Mg-7Zn; (b) Mg-7Zn-0.3V and Mg-7Zn.
Figure 7:
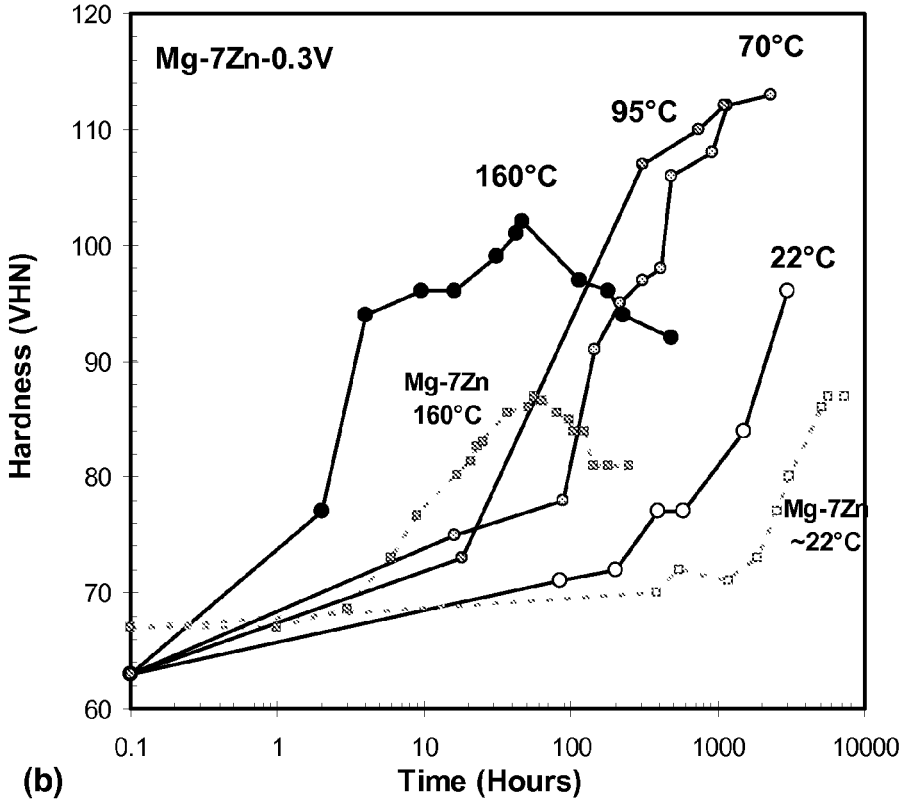

FIG. 7 compares the hardness curves for ageing at 160° C. (T6), 95° C., 70° C. and ~22° C. of alloys (a) Mg-6Zn-0.2Cr and (b) Mg-7Zn-0.3V with hardness curves for ageing at 160° C. (T6) and ~22° C. for alloy Mg-7Zn. As can be seen, chromium and particularly vanadium act as accelerants of reduced temperature ageing, in addition to notably enhancing the T6 ageing response when compared to Mg-7Zn alloy. The peak hardness achieved for ageing at 95° C. and 70° C. for both alloys containing the accelerants exceed that of the T6 conditions of the same alloys.

Figure 8:
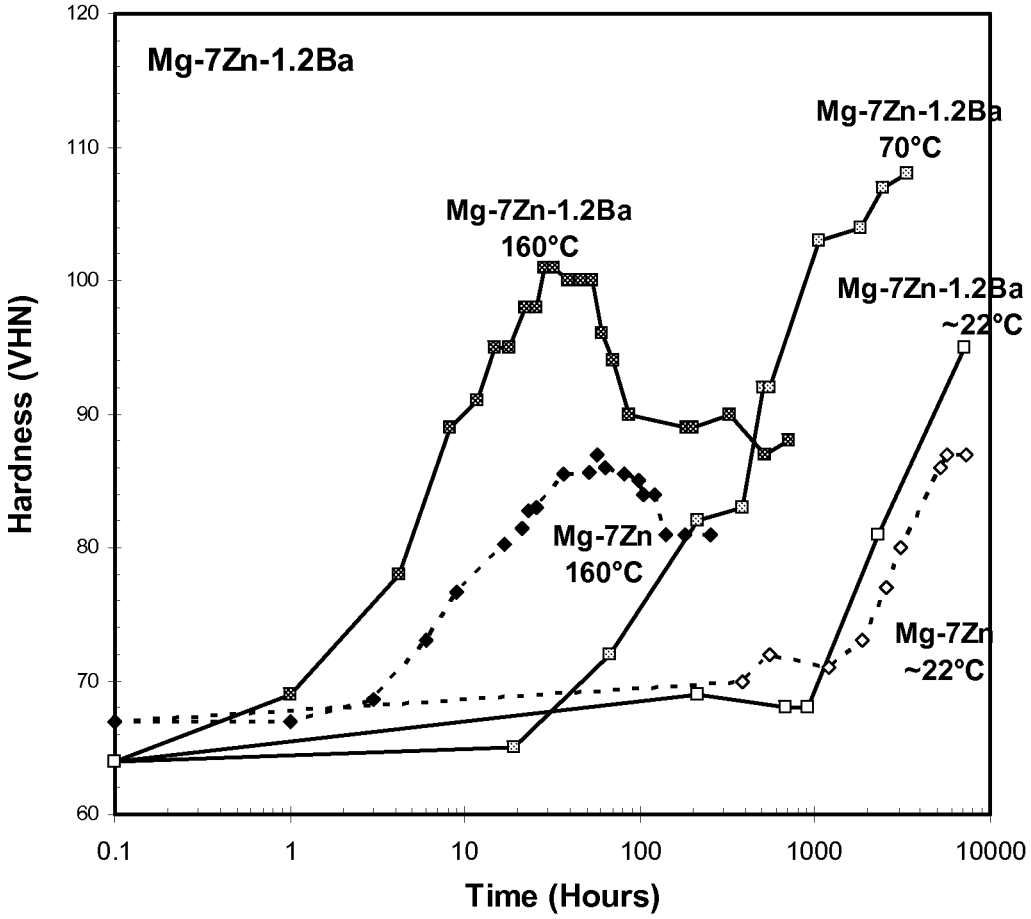
FIG. 8. Hardness (VHN) vs Time (hours) plots showing a comparison of the hardness curves between alloy Mg-7Zn-1.2Ba for ageing at 160° C. (T6), 70° C. and ~22° C., and alloy Mg-7Zn for ageing at 160° C. and ~22° C.

FIG. 8 shows that barium represents a moderate accelerant of reduced temperature ageing, in addition to significantly enhancing the T6 ageing response when compared to Mg-7Zn alloy. It is also shown that the peak hardness achieved by ageing at 70° C. exceed that of the T6 condition of the same alloy.

Figure 9:
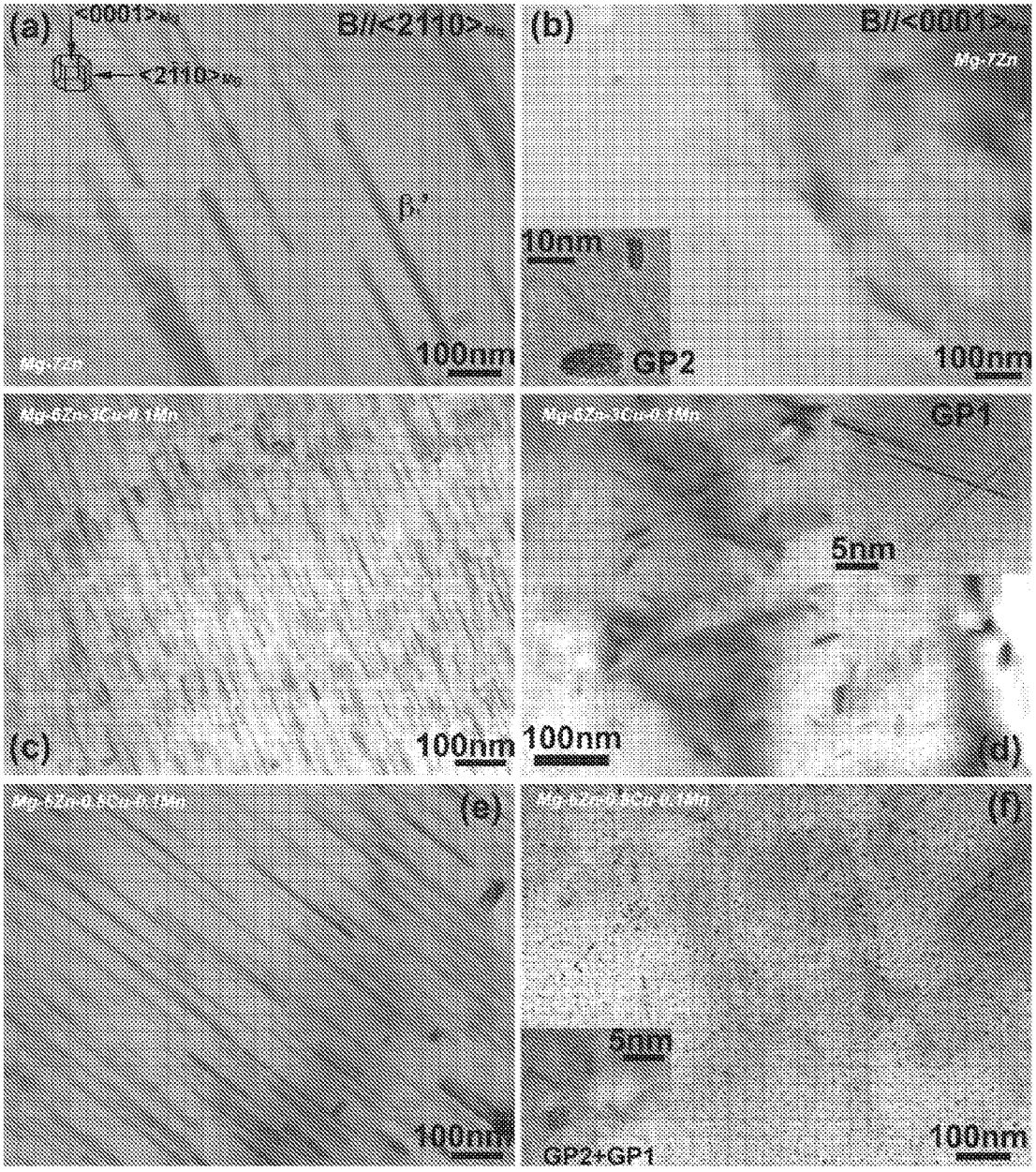
FIG. 9. Transmission electron microscopy (TEM) images of microstructures aged at 160° C. (all images on the left) and those aged at ~22° C. (all images on the right) for alloys: Mg-7Zn (a, b), Mg-6Zn-3Cu-0.1Mn (c, d) and Mg-6Zn-0.8Cu-0.1Mn (e, f).

FIG. 9 shows TEM images of alloy microstructures aged at 160° C. (a, c, e) and those aged at ~22° C. (b, d, f) for the alloy compositions Mg-7Mn (a, b), Mg-6Zn-3Cu-0.1Mn (c, d) and Mg-6Zn-0.8Cu-0.1 Mn (e, f). Precipitates seen in the T6 condition of the alloys are those referred to as the $\beta'_1$ rods which from perpendicular to $\{0001\}_{Mg}$ planes (parallel to $<0001>_{Mg}$ direction). These TEM images are taken with the electron beam parallel to $<2\bar{1}\bar{1}0>_{Mg}$ direction so that the rod-like precipitates are seen edge on. The density of these precipitates is increased in the T6 condition of the Cu containing alloys proportionally to the content of Cu.

In alloy Mg-7Zn aged at ambient temperature for 11 weeks (b) a relatively low density of sparsely distributed prismatic precipitates formed perpendicular to $\{\mathbf{0001}\}_{Mg}$ planes, believed to be GP2 zones, are observed with the electron beam parallel to $<0001>_{Mg}$ direction (inset image show a high resolution TEM-HRTEM, image of these precipitates). A smaller fraction of planar GP1 zones (formed perpendicular to $\{0001\}_{Mg}$ planes) were also occasionally observed in this condition.

In alloy Mg-6Zn-3Cu-0.1Mn aged at ambient temperature for 11 weeks (d) a very high density of homogeneously distributed precipitates was observed with the electron beam parallel to $<0001>_{Mg}$ direction. The majority of these precipitates were planar GP1 zones (shown in inset HRTEM image). A smaller fraction of very fine GP2 zones was also observed in this condition. The number density of the precipitates in this condition was determined to be of the order of $10^{24}$ precipitates/$m^3$ which is significantly higher than what is commonly observed in the T6 condition of magnesium alloys (~$10^{18}$-$10^{20}$ precipitates/$m^3$).

Also, in alloy Mg-6Zn-0.8Cu-0.1Mn aged at ambient temperature for 12 weeks (f) a very high density of homogeneously distributed precipitates was observed with the electron beam parallel to $<0001>_{Mg}$ direction. A significant proportion of these precipitates were fine GP2 zones combined with fine GP1 zones (both are shown in inset HRTEM image). This image shows the change in the morphology/type of GP zones with the change in the content of the alloying element/s that promote precipitate nucleation for unchanged Zn content. The formation of the prismatic GP2 zones is more favorable than the formation of the planar GP1 zones when the content if Cu is reduced.

Figure 10:
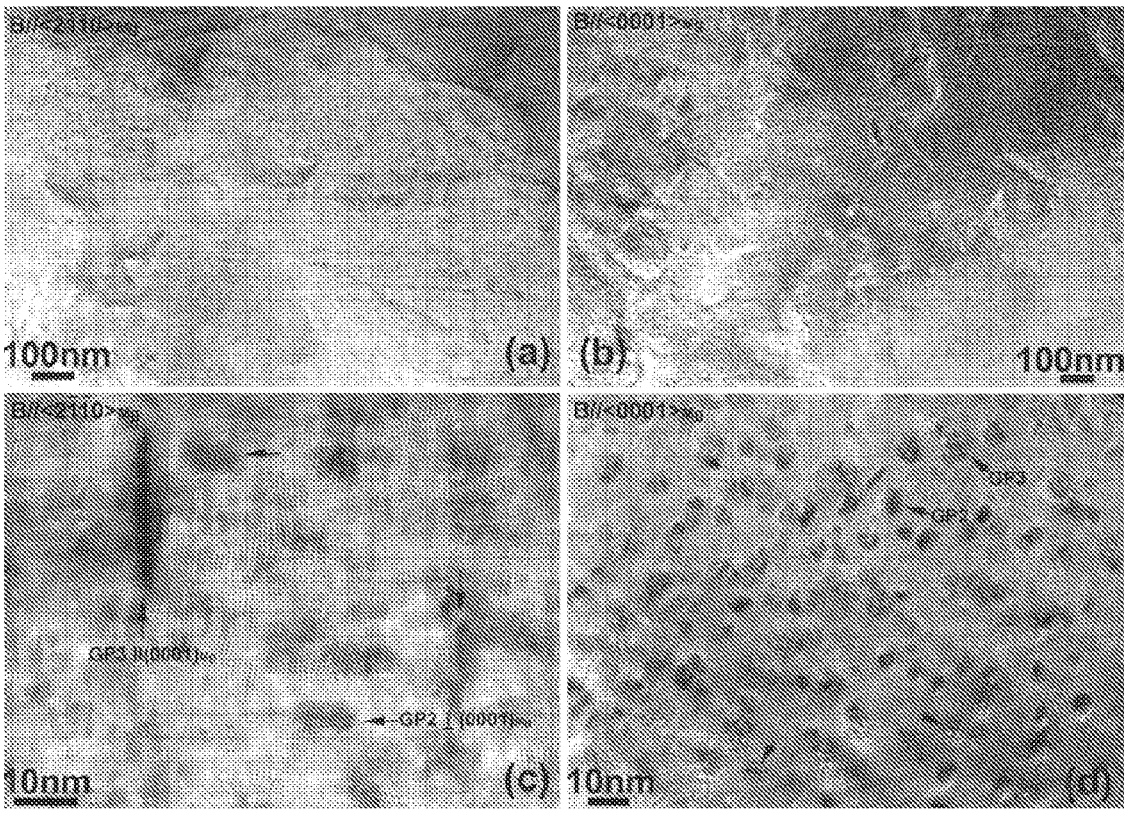
FIG. 10. TEM (a, b) and HRTEM (c, d) images of microstructure of alloy Mg-6Zn-3Cu-0.1 Mn aged at 70° C. for 4 weeks taken with the electron beam parallel to $<2\bar{1}\bar{1}0>_{Mg}$ direction (a, c) and also parallel to $<0001>_{Mg}$ direction (b, d).

FIG. 10 shows TEM (a, b) and HRTEM (c, d) images of the microstructure of an alloy having the composition Mg-6Zn-3Cu-0.1Mn, which has been aged at 70° C. for 4 weeks. An extremely high density of very fine GP zone type precipitates distributed homogeneously is observed in this condition. HRTEM images show that these precipitates are mainly prismatic GP2 zones formed perpendicular to $\{0001\}_{Mg}$ planes and planar GP3 zones formed parallel to $\{0001\}_{Mg}$ planes. Some GP1 zones were also occasionally observed in this condition.

Figure 11:
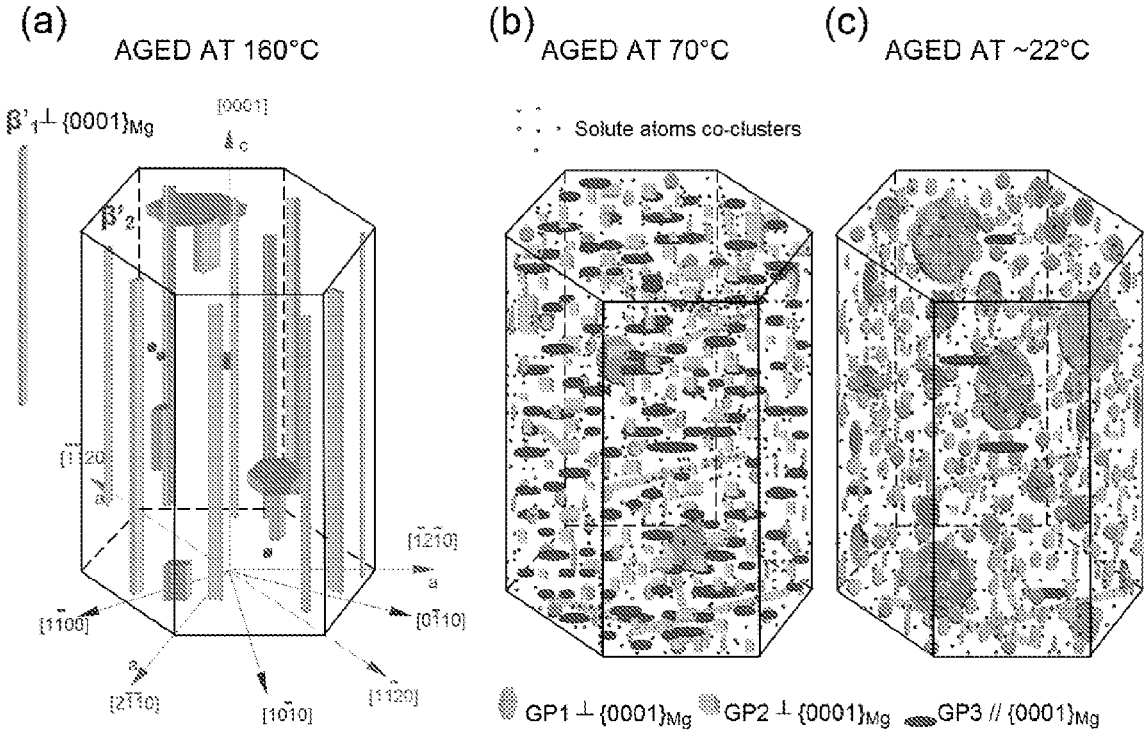
FIG. 11. Models of microstructures believed to be produced during ageing at 160° C., 70° C. and ~22° C. based on TEM observations.

FIG. 11 presents proposed models of the alloy microstructures, based on the TEM observations believed to be produced during ageing at 160° C. (a), 70° C. (b) and ~22° C. (c). Microstructures aged at reduced temperatures (b and c) exhibit a significantly higher density of finer precipitates than the microstructure aged to T6 condition (a), which is comparable to that normally observed in age-hardened aluminum alloys (~$10^{23}$-$10^{24}$ precipitates/$m^3$). This kind of microstructure offers a favorable combination of improved ductility, hardness, ultimate tensile strength and (anticipated) fracture toughness combined with the reasonable (in the case of ambient temperature ageing) or comparable and even improved tensile strength (in the case of the ageing at temperatures above the ambient temperature but considerably lower than the T6 ageing temperature) when compared to that produced during the conventional T6 heat treatment.

Finally, it is to be understood that various alterations, modifications and/or additions may be introduced into the constructions and arrangements of parts previously described without departing from the spirit or ambit of the invention.

The claims defining the invention are as follows:

1. A method for the low temperature heat treatment of an age-hardenable magnesium-based alloy comprising an improvement in tensile strength and one or more of peak hardness, yield strength, ductility and fracture toughness, including the steps:

(a) providing a solution heat-treated and quenched age-hardenable magnesium based alloy having a close packed hexagonal lattice structure; and (b) subjecting said alloy to low temperature ageing below 100° C. for a period of time sufficient to develop an enhanced ageing response, wherein the aged alloy includes Guinier-Preston (GP) zone precipitates including GP1 and GP2 precipitates formed perpendicular to a magnesium basal plane.

2. The method of claim 1, wherein said enhanced ageing response comprises at least an improvement in both tensile strength and ductility.

3. The method of claim 1, wherein said age-hardenable magnesium-based alloy is a Mg—Zn based alloy.

4. The method of claim 1, wherein said enhanced ageing response is comparable to or exceeding that of an alloy having the same composition subjected to a T6 ageing stage.

5. The method of claim 1, wherein said alloy includes one or more accelerants comprising alloying elements that accelerate said low temperature age hardening.

6. The method of claim 5, wherein said one or more accelerants are selected from the group consisting of copper, manganese and aluminium.

7. The method of claim 5, wherein said one or more accelerants are selected from the group consisting of titanium, vanadium, chromium and barium.

8. The method of claim 1, wherein said low temperature ageing causes precipitation of a high number density of said GP zone precipitates having a size of 3 to 30 nm.

9. The method of claim 1, wherein said low temperature ageing causes precipitation of said GP zone precipitates having a number density of the precipitates in the low temperature aged condition higher than about $10^{18}$-$10^{20}$ precipitates/$m^3$.

10. The method of claim 1, wherein the low temperature ageing is conducted for at least 24 hours.

11. The method of claim 1, wherein the low temperature ageing is conducted for at least 2 weeks.

12. The method of claim 1, wherein the low temperature ageing is conducted for at least 8 weeks.

13. The method of claim 1, wherein the low temperature ageing is conducted immediately after quenching.

14. The method for producing an age-hardenable magnesium-based alloy comprising an improvement in tensile strength and one or more of peak hardness, yield strength, ductility and fracture toughness, including the steps:

(a) solution treating, within a suitable elevated temperature range or ranges, an age-hardenable magnesium based alloy for a time or times sufficient to allow the elements active in the precipitation reaction to be dissolved into solid solution;

(b) quenching the solution treated alloy from the temperature cycle for step (a) whereby the dissolved elements are retained in a supersaturated solid solution to produce a quenched alloy having a close-packed hexagonal lattice structure; and (c) subjecting the quenched alloy from step (b) to low temperature ageing below 100° C. for a period of time sufficient to develop an enhanced ageing response, wherein the aged alloy includes Guinier-Preston (GP) zone precipitates including G1 and GP2 precipitates formed perpendicular to a magnesium basal plane.

15. The method of claim 14, wherein said elevated temperature range of step (a) is 5° to 20° C. below the alloy solidus temperature.

16. The method of claim 14, wherein said elevated temperature range of step (a) is such as to maximize supersaturation of vacancies in solid solution after quenching.

17. The method of claim 1, wherein the low temperature ageing is conducted at a temperature greater than ambient temperature.

18. The method of claim 1, wherein the low temperature ageing is conducted at a temperature less than or equal to 95° C.

19. The method of claim 1, wherein said low temperature ageing causes precipitation of said GP zone precipitates having a number density of the precipitates in the low temperature aged condition around $10^{23}$-$10^{24}$ precipitates/$m^3$.

* * * * *